US009459573B2

(12) United States Patent
Ueda

(10) Patent No.: US 9,459,573 B2
(45) Date of Patent: Oct. 4, 2016

(54) FIXING DEVICE IN WHICH TEMPERATURE OF HEATING ROLLER IS DETECTED USING NON-CONTACT TEMPERATURE SENSOR AND IMAGE FORMING APPARATUS INCLUDING FIXING DEVICE

(71) Applicant: KYOCERA Document Solutions Inc., Osaka (JP)

(72) Inventor: Hiroyuki Ueda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/001,737

(22) Filed: Jan. 20, 2016

(65) Prior Publication Data

US 2016/0231680 A1 Aug. 11, 2016

(30) Foreign Application Priority Data

Feb. 10, 2015 (JP) ..... 2015-024105

(51) Int. Cl.
*G03G 15/20* (2006.01)

(52) U.S. Cl.
CPC ..... *G03G 15/2064* (2013.01)

(58) Field of Classification Search
CPC ..... G03G 15/2017; G03G 15/2039; G03G 21/206
USPC ..... 399/69, 92
See application file for complete search history.

(56) References Cited

U.S. PATENT DOCUMENTS 8,401,428 B2 * 3/2013 Aratachi et al. ... G03G 15/2039 399/122
9,176,440 B2 * 11/2015 Honda et al. ..... G03G 15/2039

FOREIGN PATENT DOCUMENTS

JP 2006-300701 A 11/2006

* cited by examiner

*Primary Examiner* — William J Royer
(74) *Attorney, Agent, or Firm* — Studebaker & Brackett PC

(57) ABSTRACT

A fixing device includes a heating roller, a non-contact temperature sensor, a first air channel, and a second air channel. The non-contact temperature sensor detects a temperature of the heating roller in a non-contact manner. The first air channel is located between the non-contact temperature sensor and the heating roller. The second air channel is located at a side of the non-contact temperature sensor that is farther from the heating roller. An air velocity in the first air channel is greater than an air velocity in the second air channel.

8 Claims, 5 Drawing Sheets

FIXING DEVICE IN WHICH TEMPERATURE OF HEATING ROLLER IS DETECTED USING NON-CONTACT TEMPERATURE SENSOR AND IMAGE FORMING APPARATUS INCLUDING FIXING DEVICE

INCORPORATION BY REFERENCE

The present application claims priority under 35 U.S.C. §119 to Japanese Patent Application No. 2015-024105, filed on Feb. 10, 2015. The contents of this application are incorporated herein by reference in their entirety.

BACKGROUND

The present disclosure relates to a fixing device and an image forming apparatus.

It is generally known to detect a temperature of a heating roller in a fixing device.

For example, a fixing device is disclosed in which a temperature of a heating roller therein is detected using a non-contact temperature sensor. The fixing device has the following configuration. That is, the fixing device includes a non-contact temperature sensor, a blowing means, and a guide member. The non-contact temperature sensor includes a temperature detecting section on a bottom face thereof and is disposed above the heating roller with a specified distance therebetween. The blowing means is disposed above the non-contact temperature sensor and blows air toward the non-contact temperature sensor. The guide member extends from a bottom face of the blowing means to the vicinity of a surface of the heating roller so as to cover the non-contact temperature sensor.

According to the fixing device, air flow from the blowing means prevents extraneous matter from adhering to the temperature detecting section, and thus the temperature can be detected more accurately.

SUMMARY

A fixing device of the present disclosure is a fixing device for fixing a toner image onto a recording medium. The fixing device includes a heating roller, a pressure roller, a non-contact temperature sensor, a first air channel, and a second air channel. The non-contact temperature sensor detects a temperature of the heating roller in a non-contact manner. The first air channel is located between the non-contact temperature sensor and the heating roller. The second air channel is located at a side of the non-contact temperature sensor that is farther from the heating roller. An air velocity in the first air channel is greater than an air velocity in the second air channel.

An image forming apparatus of the present disclosure is an image forming apparatus for forming an image on a recording medium. The image forming apparatus includes the above-described fixing device.

DETAILED DESCRIPTION

Figure 1:
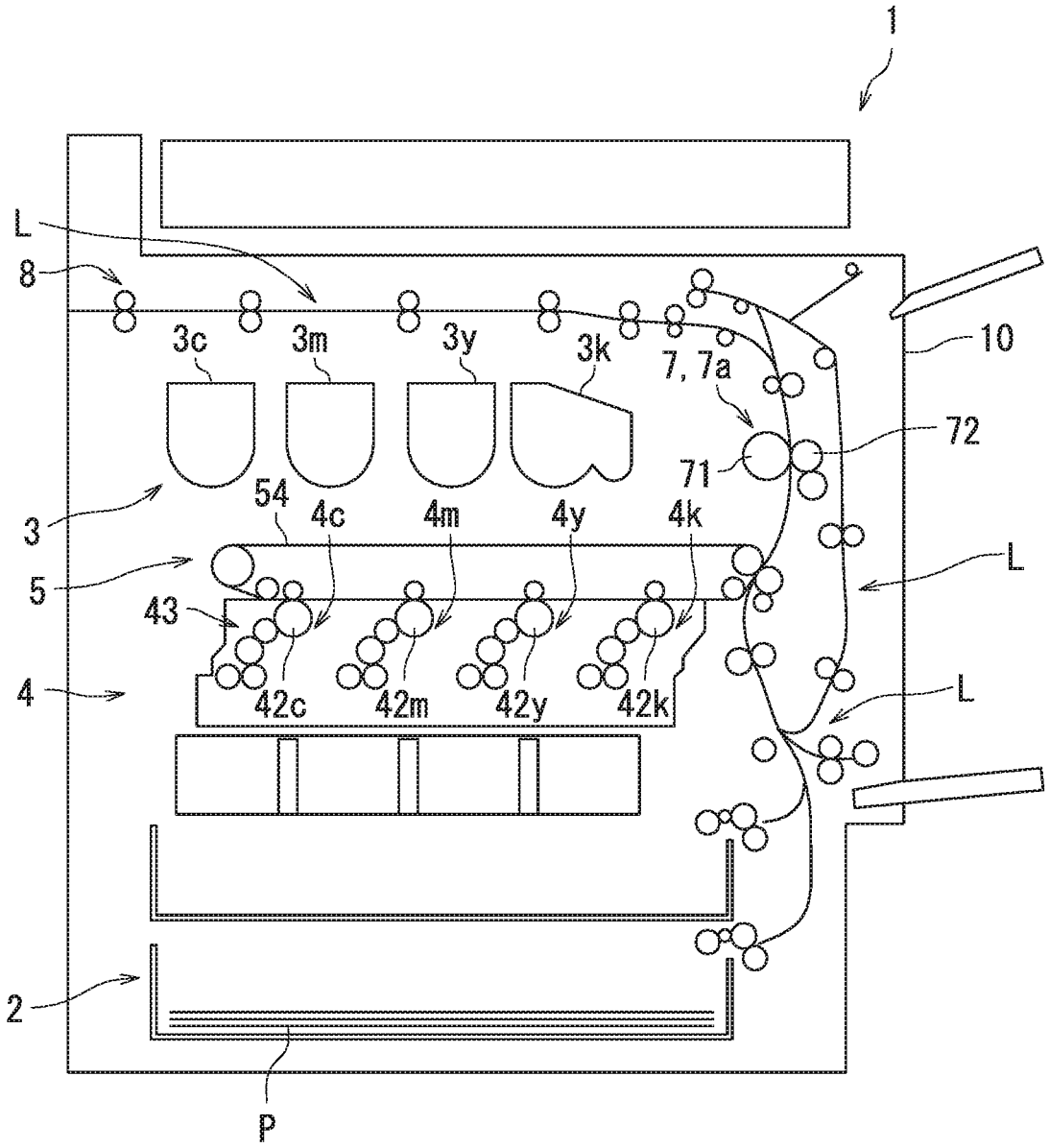
FIG. 1 is a side view illustrating a configuration of an image forming apparatus according to an embodiment of the present disclosure.

Hereinafter, embodiments of the present disclosure will be described with reference to the accompanying drawings (FIGS. 1 to 5). Elements in the drawings that are the same or equivalent are marked by the same reference signs and description thereof is not repeated.

First, an image forming apparatus 1 according to an embodiment will be described with reference to FIG. 1. FIG. 1 is a diagram illustrating a configuration of the image forming apparatus 1 according to the present embodiment. In the present embodiment, the image forming apparatus 1 is a color copier.

As illustrated in FIG. 1, the image forming apparatus 1 is an apparatus that forms an image on a recording sheet P. The image forming apparatus 1 includes a housing 10, a sheet feed section 2, a conveyance section L, a toner replenishment unit 3, an image formation unit 4, a transfer section 5, a fixing section (fixing device) 7, and an ejection section 8.

The sheet feed section 2 is disposed in a lower part of the housing 10 and feeds a recording sheet P to the conveyance section L. The sheet feed section 2 is capable of containing a plurality of recording sheets P and picks up an uppermost recording sheet P to feed the recording sheets P to the conveyance section L one sheet at a time. Hereinafter, the recording sheet P is referred to as a sheet P for convenience.

The conveyance section L conveys a sheet P fed by the sheet feed section 2 to the ejection section 8 via the transfer section 5 and the fixing section 7.

The toner replenishment unit 3 is a container for supplying toners to the image formation unit 4 and includes four toner cartridges 3*c*, 3*m*, 3*y*, and 3*k*. The toner cartridge 3*c* contains a cyan toner. The toner cartridge 3*m* contains a magenta toner. The toner cartridge 3*y* contains a yellow toner. The toner cartridge 3*k* contains a black toner.

Hereinafter, the toner cartridges 3*c*, 3*m*, and 3*y* may be referred to as non-black toner cartridges, and the toner cartridge 3*k* may be referred to as a black toner cartridge.

The transfer section 5 includes an intermediate transfer belt 54. The transfer section 5 transfers onto a sheet P toner images formed on the intermediate transfer belt 54 by the image formation unit 4. Configuration of the transfer section 5 will be described later with reference to FIG. 2.

The image formation unit 4 forms toner images on the intermediate transfer belt 54. The non-black toner cartridges supply the non-black toners to the image formation unit 4. The black toner cartridge supplies the black toner to the image formation unit 4. More specifically, the image formation unit 4 includes four image forming sections 4*c*, 4*m*, 4*y*, and 4*k*. The image forming section 4*c* is supplied with the cyan toner from the toner cartridge 3*c*. The image forming section 4*m* is supplied with the magenta toner from the toner cartridge 3*m*. The image forming section 4*y* is supplied with the yellow toner from the toner cartridge 3*y*. The image forming section 4*k* is supplied with the black toner from the toner cartridge 3*k*. Configuration of the image formation unit 4 will be described later with reference to FIG. 2.

The fixing section 7 is formed from a pair of rollers for fixing the toner images transferred onto the sheet P by the transfer section 5, including a heating roller 71 and a pressure roller 72. The heating roller 71 and the pressure roller 72 apply heat and pressure to the sheet P. As a result, the unfixed toner images transferred onto the sheet P by the transfer section 5 are fixed by the fixing section 7.

The ejection section 8 ejects the sheet P having the toner images fixed thereon out of the image forming apparatus 1.

Figure 2:
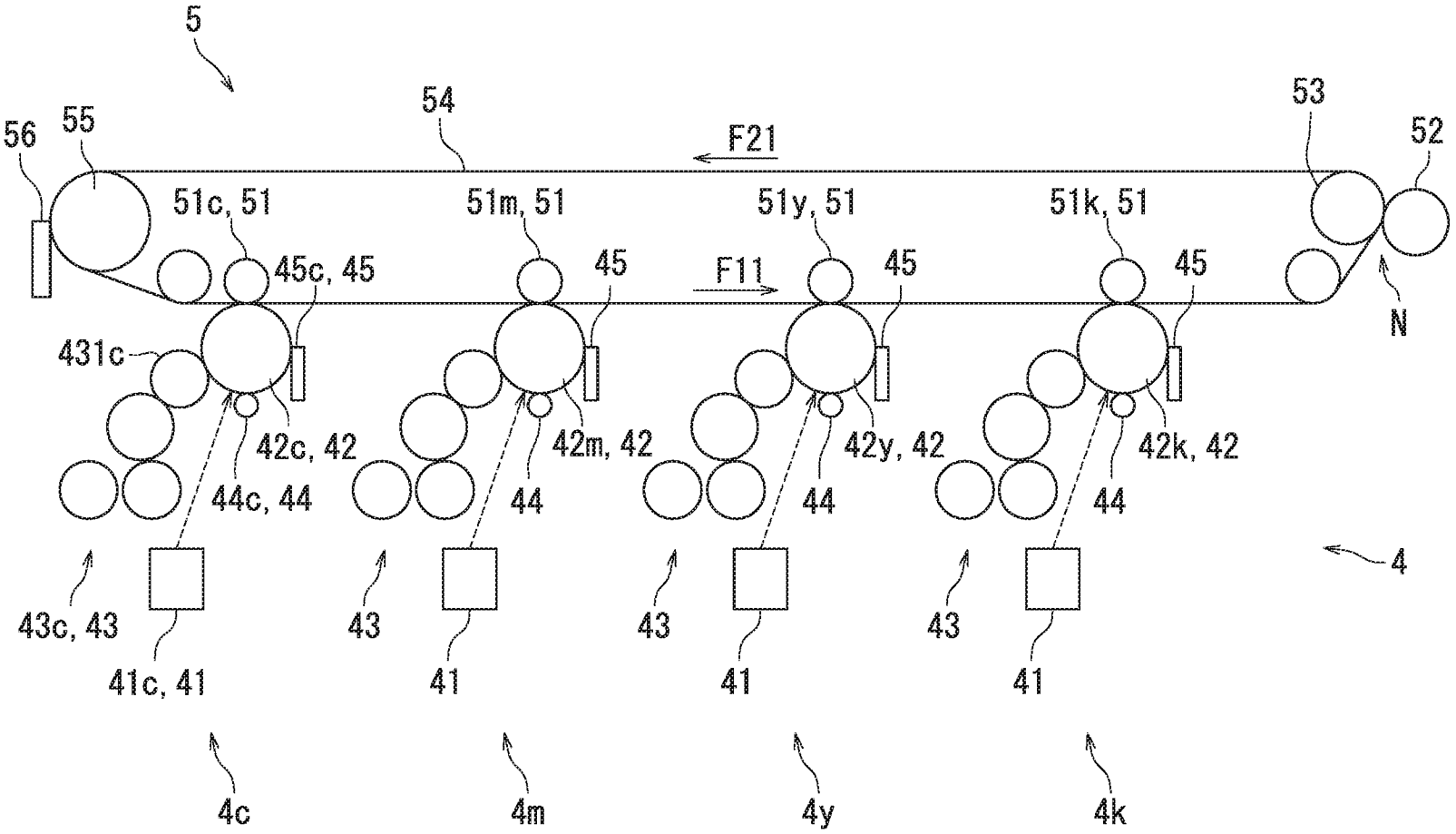
FIG. 2 is a side view illustrating a configuration of an image formation unit and a transfer section illustrated in FIG. 1.

Next, configuration of the image formation unit 4 and the transfer section 5 will be described with reference to FIG. 2. FIG. 2 is a side view illustrating a configuration of the image formation unit 4 and the transfer section 5. As illustrated in FIG. 2, the image formation unit 4 includes the four image forming sections 4*c*, 4*m*, 4*y*, and 4*k*.

The image forming sections 4*c*, 4*m*, 4*y*, and 4*k* each include a light exposure device 41, a photosensitive drum 42, a development section 43, a charging roller 44, and a cleaning blade 45. The four image forming sections 4*c*, 4*m*, 4*y*, and 4*k* have substantially the same configuration except the colors of the toners to be supplied thereto. In the present specification, therefore, configuration of the image forming section 4*c* to which the cyan toner is supplied is described, and description of the configuration of the image forming sections 4*m*, 4*y*, and 4*k* other than the image forming section 4*c* is omitted.

The image forming section 4*c* has a light exposure device 41*c* (41), a photosensitive drum 42*c* (42), a development section 43*c* (43), a charging roller 44*c* (44), and a cleaning blade 45*c* (45).

The charging roller 44*c* charges the photosensitive drum 42*c* to a specific electrical potential. The light exposure device 41*c* performs light exposure by irradiating the photosensitive drum 42*c* with laser light to form an electrostatic latent image on the photosensitive drum 42*c*. The development section 43*c* has a development roller 431*c*. The development roller 431*c* supplies the cyan toner to the photosensitive drum 42*c* to develop the electrostatic latent image into a toner image. Thus, a cyan toner image is formed on a circumferential surface of the photosensitive drum 42*c*.

The cleaning blade 45*c* has an end (upper end in FIG. 2) in sliding contact with the circumferential surface of the photosensitive drum 42*c*. The end of the cleaning blade 45*c* in sliding contact with the circumferential surface of the photosensitive drum 42*c* removes cyan toner remaining on the circumferential surface of the photosensitive drum 42*c*.

The transfer section 5 transfers toner images onto a sheet P (see FIG. 1). The transfer section 5 includes four primary transfer rollers 51 (51*c*, 51*m*, 51*y*, and 51*k*), a secondary transfer roller 52, a drive roller 53, the intermediate transfer belt 54, and a driven roller 55.

The transfer section 5 transfers toner images formed on the respective photosensitive drums 42 (42*c*, 42*m*, 42*y*, and 42*k*) of the image forming sections 4*c*, 4*m*, 4*y*, and 4*k* to the intermediate transfer belt 54 such that the toner images are superimposed on one another, and subsequently transfers the superimposed toner images from the intermediate transfer belt 54 to a sheet P (see FIG. 1).

The primary transfer roller 51*c* is disposed opposite to the photosensitive drum 42*c* with the intermediate transfer belt 54 therebetween. The primary transfer roller 51*c* is pressed against the photosensitive drum 42*c* and separated from the photosensitive drum 42*c* with the intermediate transfer belt 54 therebetween by a drive mechanism, not shown. The primary transfer roller 51*c* is normally in pressed contact with the photosensitive drum 42*c* with the intermediate transfer belt 54 therebetween. Like the primary transfer roller 51*c*, the other primary transfer rollers 51*m*, 51*y*, and 51*k* are in pressed contact with the respective photosensitive drums 42 (42*m*, 42*y*, and 42*k*) with the intermediate transfer belt 54 therebetween.

The drive roller 53 is disposed opposite to the secondary transfer roller 52 and drives the intermediate transfer belt 54.

The intermediate transfer belt 54 is an endless belt stretched around the four primary transfer rollers 51, the drive roller 53, and the driven roller 55. The intermediate transfer belt 54 is driven by the drive roller 53 to rotate in a counterclockwise direction as indicated by arrows F11 and F21 in FIG. 2. An outer surface of the intermediate transfer belt 54 is in contact with peripheral surfaces of the respective photosensitive drums 42 (42*c*, 42*m*, 42*y*, and 42*k*). The primary transfer rollers 51 (51*c*, 51*m*, 51*y*, and 51*k*) transfer toner images from the respective photosensitive drums 42 (42*c*, 42*m*, 42*y*, and 42*k*) to the surface of the intermediate transfer belt 54.

More specifically, the intermediate transfer belt 54 is for example a seamless belt made of a resin such as polyimide, polycarbonate, and polyvinylidene fluoride.

The driven roller 55 is rotationally driven by rotation of the intermediate transfer belt 54. A blade 56 is disposed opposite to the driven roller 55 with the intermediate transfer belt 54 therebetween. The blade 56 removes toner remaining on the surface of the intermediate transfer belt 54.

The secondary transfer roller 52 is pressed against the drive roller 53. The secondary transfer roller 52 and the drive roller 53 form a nip N therebetween. The secondary transfer roller 52 and the drive roller 53 transfer the toner images from the intermediate transfer belt 54 to a sheet P (see FIG. 1) as the sheet P passes through the nip N.

Figure 3:
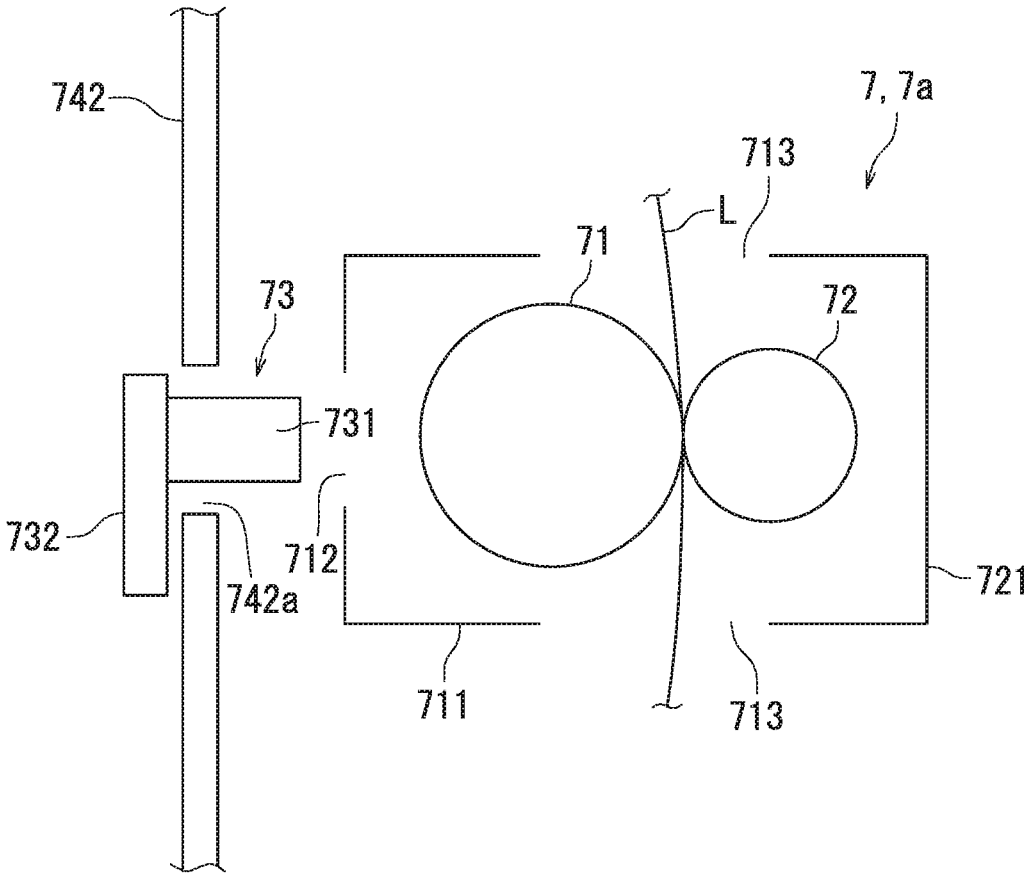
FIG. 3 is a side view illustrating a configuration of a fixing section illustrated in FIG. 1.

Next, a configuration of the fixing section 7 will be described with reference to FIG. 3. FIG. 3 is a side view illustrating a configuration of the fixing section 7 illustrated in FIG. 1. As illustrated in FIG. 3, the fixing section 7 includes a non-contact temperature sensor 73, frames 711 and 721, and a plate member 742 (second plate member) in addition to the heating roller 71 and the pressure roller 72.

The non-contact temperature sensor 73 is a sensor that detects a temperature of the heating roller 71 in a non-contact manner. More specifically, the non-contact temperature sensor 73 includes a thermopile 731 and a substrate 732. The thermopile 731 converts thermal energy from the heating roller 71 into electrical energy. The substrate 732 calculates the temperature from the electrical energy detected by the thermopile 731.

The frame 711 supports the heating roller 71 and covers a periphery of the heating roller 71. The frame 721 supports the pressure roller 72 and covers a periphery of the pressure roller 72. There is an opening 713 between the frame 711 and the frame 721 in which the conveyance section L is located and through which a sheet P can be conveyed. A side of the frame 711 that faces the non-contact temperature sensor 73 (left-hand side in FIG. 3) has a hole 712 formed in order not to prevent the non-contact temperature sensor 73 from measuring the temperature of the heating roller 71.

The plate member 742 supports the non-contact temperature sensor 73. In other words, the non-contact temperature sensor 73 is fixed to the plate member 742. The plate member 742 has a hole 742*a* (communication hole). The thermopile 731 is inserted into the hole 742*a* from a side of the plate member 742 that is farther from the heating roller 71 (from a left-hand side in FIG. 3) to a side of the plate member 742 that is closer to the heating roller 71 (to a right right-hand side in FIG. 3).

The thermopile 731 and the substrate 732 forming the non-contact temperature sensor 73 is fixed at a location spaced from the plate member 742. More specifically, the substrate 732 and the plate member 742 have a gap therebetween through which air flows along the plate member 742. Furthermore, the thermopile 731 and the plate member 742 (a periphery of the hole 742*a*) have a gap therebetween through which air flows in directions perpendicular to the plate member 742 (right and left directions in FIG. 3).

First Embodiment

Figure 4:
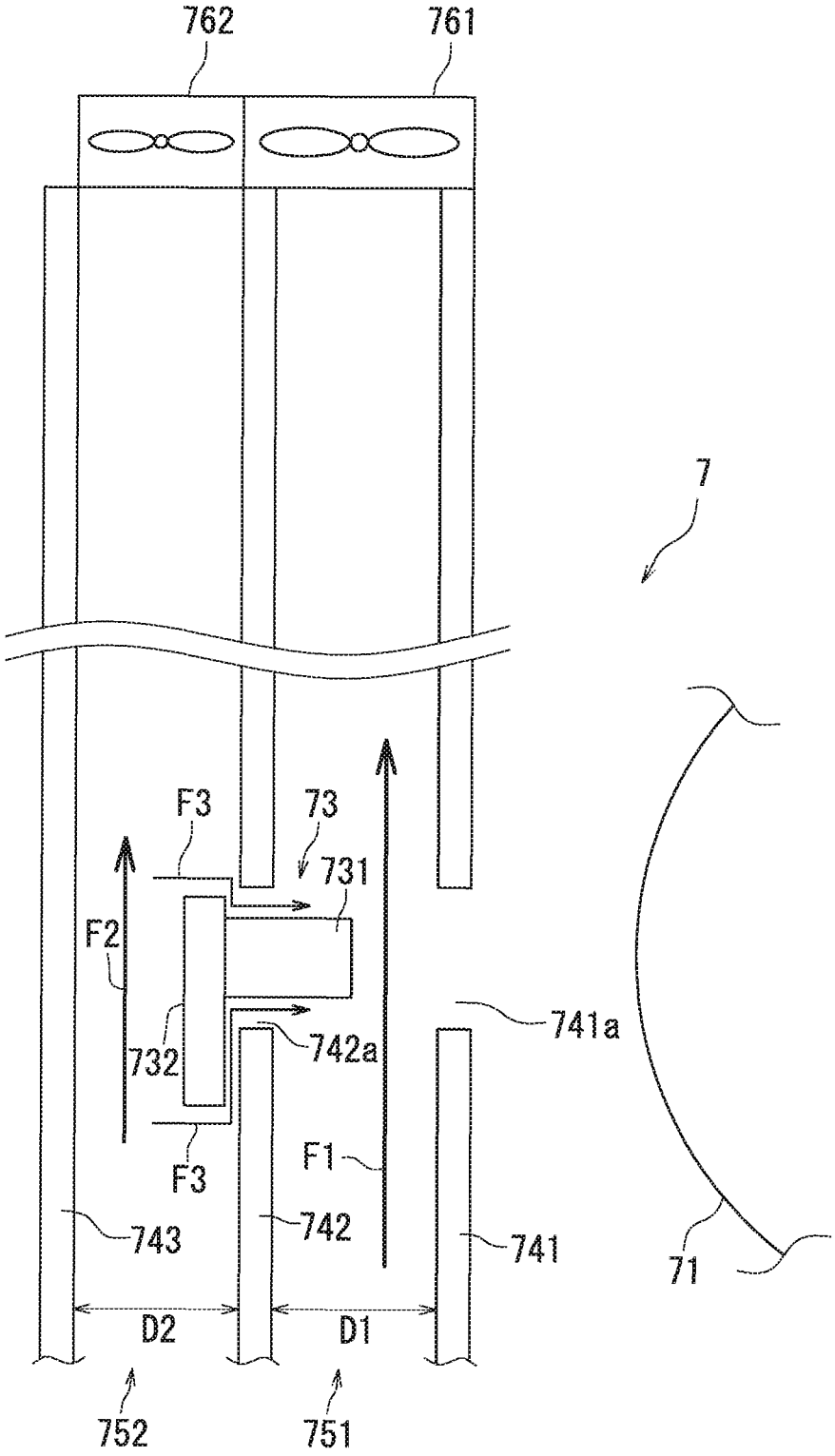
FIG. 4 is a side view illustrating a first embodiment of the fixing section illustrated in FIG. 3.

Next, the fixing section 7 according to a first embodiment of the present disclosure will be described with reference to FIG. 4. FIG. 4 is a side view illustrating the first embodiment of the fixing section 7 illustrated in FIG. 3. As illustrated in FIG. 4, the fixing section 7 includes a plate member 741 (first plate member), a plate member 743 (third plate member), a suction fan 761 (first suction fan, first negative pressure applying section), and a suction fan 762 (second suction fan, second negative pressure applying section).

The plate member 741 is located at the side of the plate member 742 that is closer to the heating roller 71 (right-hand side in FIG. 4) and disposed substantially parallel to the plate member 742. A space between the plate member 741 and the plate member 742 constitutes a first air channel 751. The plate member 741 has a hole 741*a* at a location therein that is opposite to the thermopile 731 forming the non-contact temperature sensor 73 in order not to prevent the non-contact temperature sensor 73 from measuring the temperature of the heating roller 71.

The plate member 743 is located at the side of the plate member 742 that is farther from the heating roller 71 (left-hand side in FIG. 4) and disposed substantially parallel to the plate member 742. A space between the plate member 743 and the plate member 742 constitutes a second air channel 752. A distance D2 between the plate member 743 and the plate member 742 is substantially the same as a distance D1 (for example, 10 mm) between the plate member 741 and the plate member 742.

The suction fan 761 is disposed at an end (upper end in FIG. 4) of the first air channel 751. The suction fan 761 generates air flowing in a direction indicated by arrow F1 in the first air channel 751. The suction fan 762 is disposed at an end (upper end in FIG. 4) of the first air channel 752. The suction fan 762 generates air flowing in a direction indicated by arrow F2 in the first air channel 752.

The suction fan 761 sucks a greater air volume per unit time than the suction fan 762. Since the distance D2 is substantially the same as the distance D1 as mentioned above, an air velocity of the air flowing in the direction indicated by arrow F1 in the first air channel 751 is greater than an air velocity of the air flowing in the direction indicated by arrow F2 in the second air channel 752. Accordingly, pressure at a location of the non-contact temperature sensor 73 in the first air channel 751 is more negative than pressure at a location of the non-contact temperature sensor 73 in the second air channel 752. Such a configuration generates air flowing along the non-contact temperature sensor 73 in a direction indicated by arrows F3 (rightward) from the second air channel 752 through the hole 742*a* to the first air channel 751.

The air flowing along the non-contact temperature sensor 73 in the direction indicated by arrows F3 generated as described above prevents extraneous matter from adhering to the thermopile 731. Since the air flowing in the direction indicated by arrows F3 is produced by the air flowing in the direction indicated by arrow F1 in the first air channel 751 and the air flowing in the direction indicated by arrow F2 in the second air channel 752, the air flowing in the direction indicated by arrows F3 joins the air flowing in the direction indicated by arrow F1 once flowing into the first air channel 751. Accordingly, the air flowing in the direction indicated by arrows F3 does not reach the heating roller 71, and thus heating efficiency of the heating roller 71 can be maintained.

Second Embodiment

Figure 5:
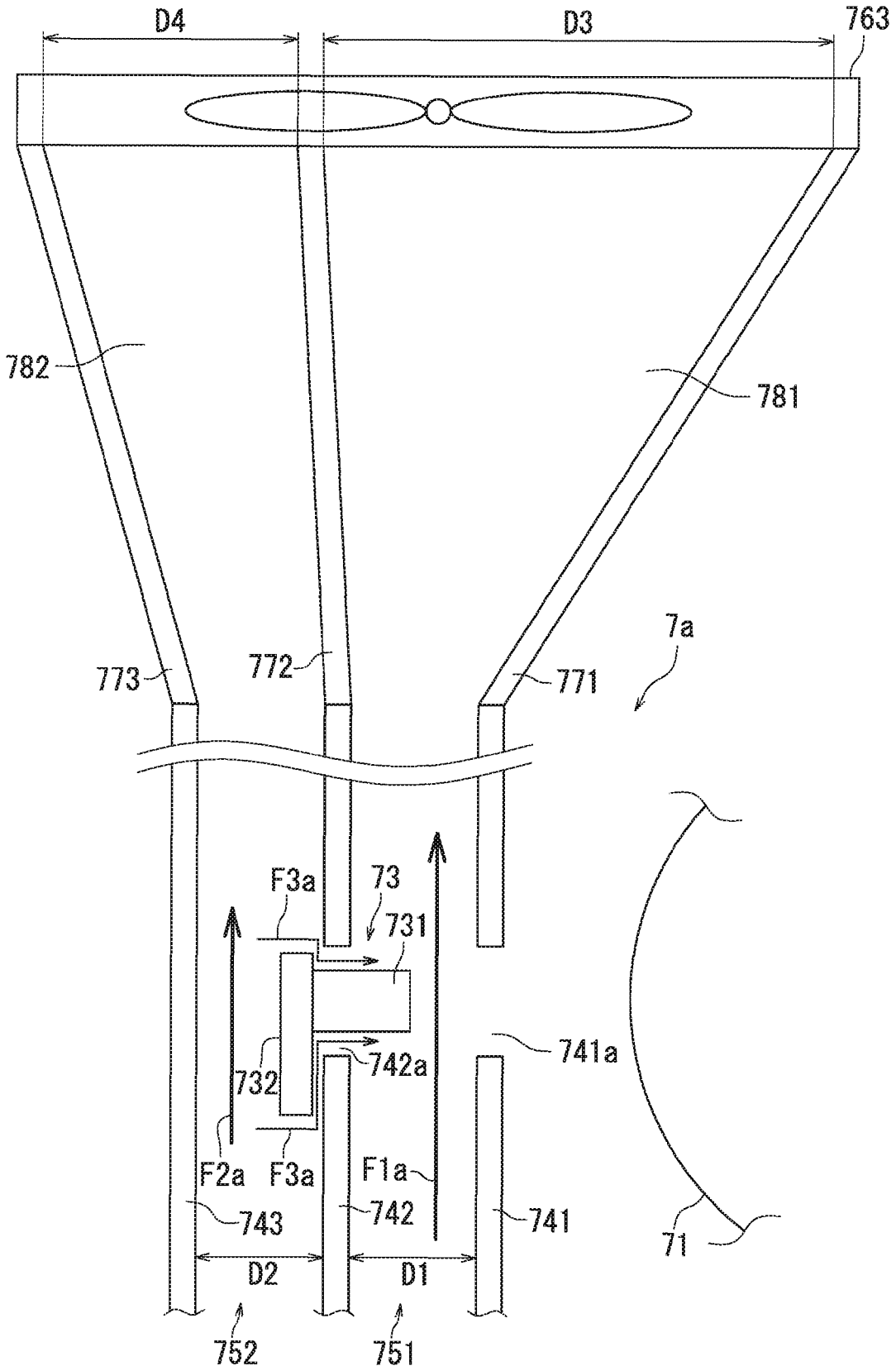
FIG. 5 is a side view illustrating a second embodiment of the fixing section illustrated in FIG. 3.

Next, a fixing section 7*a* according to a second embodiment of the present disclosure will be described with reference to FIG. 5. FIG. 5 is a side view illustrating the second embodiment of the fixing section 7 illustrated in FIG. 3. The fixing section 7*a* according to the second embodiment is different from the fixing section 7 according to the first embodiment in that the fixing section 7*a* has one suction fan. In the following description, elements that are the same as those of the fixing section 7 are marked by the same reference signs and explanation thereof is omitted in order to avoid redundancy.

The fixing section 7*a* includes a duct 781 (a part of the first negative pressure applying section), a duct 782 (a part of the second negative pressure applying section), and a suction fan 763 (the first suction fan, the second suction fan, a part of the first negative pressure applying section, and a part of the second negative pressure applying section). The suction fan 763 is connected with one end of the duct 781 and one end of the duct 782 (upper ends in FIG. 5). The other end of the duct 781 and the other end of the duct 782 (lower ends in FIG. 5) are connected with the first air channel 751 and the second air channel 752, respectively.

The duct 781 is formed between a plate member 771 and a plate member 772. One end (upper end in FIG. 5) of the plate member 771 is connected with the suction fan 763, and the other end thereof (lower end in FIG. 5) is connected with the plate member 741. One end (upper end in FIG. 5) of the plate member 772 is connected with the suction fan 763, and the other end thereof (lower end in FIG. 5) is connected with the plate member 742.

The duct 782 is formed between the plate member 772 and a plate member 773. One end (upper end in FIG. 5) of the plate member 773 is connected with the suction fan 763, and the other end thereof (lower end in FIG. 5) is connected with the plate member 743. A distance D3 (for example, 40 mm) between the plate member 771 and the plate member 772 at the one end (upper end in FIG. 5) of the duct 781 is greater than a distance D4 (for example, 20 mm) between the plate member 772 and the plate member 773 at the one end (upper end in FIG. 5) of the duct 782.

Since the distance D3 at the one end of the duct 781 is greater than the distance D4 at the one end of the duct 782, the air volume generated by the suction fan 763 per unit time is greater in the duct 781 than in the duct 782. Accordingly, an air velocity of air flowing in a direction indicated by arrow F1*a* in the first air channel 751 is greater than an air velocity of air flowing in a direction indicated by arrow F2*a* in the second air channel 752. Accordingly, pressure at a location of the non-contact temperature sensor 73 in the first air channel 751 is more negative than pressure at a location of the non-contact temperature sensor 73 in the second air channel 752. Such a configuration generates air flowing along the non-contact temperature sensor 73 in a direction indicated by arrows F3*a* (rightward) from the second air channel 752 through the hole 742*a* to the first air channel 751.

The air flowing along the non-contact temperature sensor 73 in the direction indicated by arrows F3*a* generated as described above prevents extraneous matter from adhering to the thermopile 731. Since the air flowing in the direction indicated by arrows F3*a* is produced by the air flowing in the direction indicated by arrow F1*a* in the first air channel 751 and the air flowing in the direction indicated by arrow F2*a* in the second air channel 752, the air flowing in the direction indicated by arrows F3*a* joins the air flowing in the direction indicated by arrow F1*a* once flowing into the first air channel 751. Accordingly, the air flowing in the direction indicated by arrows F3*a* does not reach the heating roller 71, and thus heating efficiency of the heating roller 71 can be maintained.

The fixing section 7*a* has a simplified configuration because the fixing section 7*a* has one suction fan 763 whereas the fixing section 7 has two suction fans 761 and 762.

The embodiments of the present disclosure have been described with reference to the drawings so far. However, the present disclosure is not limited to the above embodiments and may be implemented in various different forms that do not deviate from the essence of the present disclosure (for example, as described below in sections (1)-(4)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiments, such as shapes and dimensions, are merely examples and are not intended as specific limitations. Various alterations may be made so long as there is no substantial deviation from the configuration of the present disclosure.

(1) The first and second embodiments are described for the configuration in which the plate members 741, 742, and 743 are flat plates. Alternatively, the plate members 741, 742, and 743 may have other shapes. For example, the plate members 741, 742, and 743 may have a substantially arc shape along a peripheral surface of the heating roller 71. Such a configuration allows a space in which the fixing section is placed to be used efficiently.

(2) The first and second embodiments are described for the configuration in which the distance D2 between the plate member 743 and the plate member 742 is substantially the same as the distance D1 between the plate member 741 and the plate member 742, but other configurations may be adopted. For example, the distance D1 may be shorter than the distance D2. Such a configuration allows the air velocity in the first air channel 751 to be greater.

(3) The first and second embodiments are not particularly specified for a distance between the substrate 732 and the plate member 742 or for a distance between the thermopile 731 and the periphery of the hole 742*a*. The shorter the distance between the substrate 732 and the plate member 742, and the distance between the thermopile 731 and the periphery of the hole 742*a* are, the greater the air velocity of the air flowing in the direction indicated by arrows F3 (rightward) is and the smaller the air volume thereof per unit time is. Accordingly, the distance between the substrate 732 and the plate member 742, and the distance between the thermopile 731 and the periphery of the hole 742*a* are preferably adjusted so that the air velocity and the air volume per unit time of the air flowing in the direction indicated by arrows F3 (rightward) are suitable values.

(4) The first embodiment has been described for a configuration in which the distance D2 is substantially the same as the distance D1 and the suction fan 761 sucks a greater air volume per unit time than the suction fan 762, but other configurations may be adopted. For example, the distance D2 may be greater than the distance D1 and the suction fan 761 may suck substantially the same air volume per unit time as the suction fan 762.

What is claimed is:

1. A fixing device for fixing a toner image onto a recording medium, comprising:

a heating roller;

a pressure roller;

a non-contact temperature sensor configured to detect a temperature of the heating roller in a non-contact manner;

a first air channel located between the non-contact temperature sensor and the heating roller; and a second air channel located at a side of the non-contact temperature sensor that is farther from the heating roller, wherein an air velocity in the first air channel is greater than an air velocity in the second air channel.

2. The fixing device according to claim 1, wherein the first air channel includes:

a first plate member disposed between the non-contact temperature sensor and the heating roller;

a second plate member to which the non-contact temperature sensor is attached, the second plate member disposed substantially parallel to the first plate member; and a first negative pressure applying section configured to apply negative pressure to a space between the first plate member and the second plate member, the second air channel includes:

the second plate member;

a third plate member located at a side of the second plate member that is farther from the heating roller and disposed substantially parallel to the first plate member; and a second negative pressure applying section configured to apply negative pressure to a space between the second plate member and the third plate member, and the second plate member has a communication hole located around the non-contact temperature sensor and configured to allow air communication between the first air channel and the second air channel.

3. The fixing device according to claim 2, wherein a distance between the second plate member and the third plate member is substantially the same as a distance between the first plate member and the second plate member, and the first negative pressure applying section sucks a greater air volume per unit time than the second negative pressure applying section.

4. The fixing device according to claim 2, wherein a distance between the second plate member and the third plate member is greater than a distance between the first plate member and the second plate member, and the first negative pressure applying section sucks substantially the same air volume per unit time as the second negative pressure applying section.

5. The fixing device according to claim 2, wherein the first negative pressure applying section includes a first suction fan disposed at one end of the first plate member and one end of the second plate member, and the second negative pressure applying section includes a second suction fan disposed at the one end of the second plate member and one end of the third plate member.

6. The fixing device according to claim 5, wherein the first suction fan and the second suction fan are a single suction fan having ducts configured to communicate negative pressure generated by the single suction fan to the first air channel and the second air channel.

7. The fixing device according to claim 2, wherein the first plate member, the second plate member, and the third plate member each have a substantially arc shape along a peripheral surface of the heating roller.

8. An image forming apparatus for forming an image on a recording medium, comprising the fixing device according to claim 1.

* * * * *